US010160214B2

(12) United States Patent
Fukuda

(10) Patent No.: US 10,160,214 B2
(45) Date of Patent: Dec. 25, 2018

(54) LIQUID EJECTING APPARATUS

(71) Applicant: SEIKO EPSON CORPORATION, Tokyo (JP)

(72) Inventor: Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/804,332

(22) Filed: Nov. 6, 2017

(65) Prior Publication Data

US 2018/0126738 A1 May 10, 2018

(30) Foreign Application Priority Data

Nov. 10, 2016 (JP) ..... 2016-219655

(51) Int. Cl.

| | |
|---|---|
| ***B41J 2/165*** | (2006.01) |
| ***B41J 2/025*** | (2006.01) |
| ***B41J 2/045*** | (2006.01) |
| ***B41J 2/19*** | (2006.01) |
| ***B41J 2/20*** | (2006.01) |
| ***B41J 2/21*** | (2006.01) |
| *B41J 2/14* | (2006.01) |
| *B41J 19/66* | (2006.01) |
| *B41J 19/68* | (2006.01) |

(52) U.S. Cl.

CPC ..... *B41J 2/16579* (2013.01); *B41J 2/025* (2013.01); *B41J 2/0451* (2013.01); *B41J 2/04553* (2013.01); *B41J 2/04581* (2013.01); *B41J 2/04588* (2013.01); *B41J 2/19* (2013.01); *B41J 2/20* (2013.01); *B41J 2/2142* (2013.01); *B41J 2/14201* (2013.01); *B41J 19/66* (2013.01); *B41J 19/68* (2013.01)

(58) Field of Classification Search

CPC ..... B41J 2/16579; B41J 2/025; B41J 2/0451; B41J 2/04553; B41J 2/04581; B41J 2/04588; B41J 2/19; B41J 2/20

See application file for complete search history.

(56) References Cited

U.S. PATENT DOCUMENTS

| | | | | |
|---|---|---|---|---|
| 8,371,676 | B2 | 2/2013 | Shinkawa | |
| 2004/0252144 | A1* | 12/2004 | Higuchi | B41J 2/0451 347/5 |
| 2005/0057596 | A1* | 3/2005 | Shinkawa | B41J 2/16579 347/19 |

FOREIGN PATENT DOCUMENTS

| | | |
|---|---|---|
| JP | 2014-177127 | 9/2014 |

* cited by examiner

*Primary Examiner* — Juanita D Jackson
(74) *Attorney, Agent, or Firm* — Workman Nydegger

(57) ABSTRACT

A liquid ejecting apparatus includes a liquid ejecting head including a substrate where a plurality of hollow portions are formed, a flexible plane that delimits a part of the hollow portion, and a piezoelectric element provided corresponding to the hollow portion, an inspection mechanism that inspects ejection of liquid from a nozzle based on an electromotive force of the piezoelectric element, and a signal generation circuit that generates a first drive signal and a second drive signal. The second drive signal maintains a state, where a second vibration portion including the second piezoelectric element and the flexible plane corresponding to the second piezoelectric element is deformed, during a detection period in which the inspection mechanism performs inspection based on vibration caused when a first vibration portion including the first piezoelectric element and the flexible plane corresponding to the first piezoelectric element is driven.

6 Claims, 8 Drawing Sheets

LIQUID EJECTING APPARATUS

The entire disclosure of Japanese Patent Application No. 2016-219655, filed Nov. 10, 2016 is expressly incorporated by reference herein.

BACKGROUND

1. Technical Field

The present invention relates to a liquid ejecting apparatus such as an ink jet type recording apparatus, in particular to a liquid ejecting apparatus that causes a nozzle to eject liquid by generating pressure variation in liquid in a hollow portion that communicates with the nozzle by deforming a vibration portion that delimits a part of the hollow portion.

2. Related Art

The liquid ejecting apparatus is an apparatus that has a liquid ejecting head and ejects (discharges) various liquids from nozzles of the liquid ejecting head. An example of a typical liquid ejecting apparatus is an image recording apparatus such as an ink jet type recording apparatus (printer) that has an ink jet type recording head (hereinafter referred to as a recording head) and performs recording by ejecting ink in a liquid state as ink droplets from nozzles of the recording head. Further, the liquid ejecting apparatus is used to eject various types of liquids such as color materials used for a color filter of a liquid crystal display and the like, an organic material used for an organic EL (Electro Luminescence) display, and an electrode material used to form an electrode. A recording head for an image recording apparatus ejects ink in a liquid state, and a color material ejecting head for a display manufacturing apparatus ejects solution of each color material of R (Red), G (Green), and B (Blue). An electrode material ejecting head for an electrode forming apparatus ejects an electrode material in a liquid state, and a bioorganic material ejecting head for a chip manufacturing apparatus ejects solution of bioorganic material.

For example, in the liquid ejecting apparatus described above, there is a case where liquid is not normally ejected from a nozzle of the liquid ejecting head due to factors such as clogging due to thickening of liquid and foreign objects or bubbles existing in a flow path, that is, a case where the amount or the speed of the liquid ejected from the nozzle is different from an original target value or the liquid is not ejected from the nozzle at all in the worst case. Therefore, a technique that inspects whether or not the liquid is normally ejected from all the nozzles is proposed. For example, JP-A-2014-177127 discloses a technique that inspects ejection abnormality of ink based on residual vibration of liquid in a cavity (a hollow portion or a pressure chamber) when driving a piezoelectric element.

In the liquid ejecting head described above, a plurality of components such as a substrate where nozzles are formed and a substrate where cavities are formed are bonded with adhesive or the like. Therefore, a positional relationship between the cavities and the piezoelectric elements and dimensions of components may be different from target values due to variation in manufacturing or an adhesive that bonds substrates together may extrude to a cavity and attach to a flexible plane that delimits the cavity, so that there is a case where a vibration period of a vibration portion including a piezoelectric element and a flexible plane corresponding to the piezoelectric element may be different from a design target value (reference value). As a result, there is a risk that inspection accuracy is degraded.

SUMMARY

An advantage of some aspects of the invention is to provide a liquid ejecting apparatus that can improve detection accuracy of ejection abnormality in a configuration that inspects the ejection abnormality based on the residual vibration generated by driving the piezoelectric element.

According to an aspect of the invention, the liquid ejecting apparatus includes a liquid ejecting head including a substrate where a plurality of hollow portions are formed, a flexible plane that delimits a part of the hollow portion in the substrate, and a piezoelectric element provided corresponding to and opposite to the hollow portion with the flexible plane in between, an inspection mechanism that inspects ejection of liquid from a nozzle that communicates with the hollow portion based on an electromotive force of the piezoelectric element caused by vibration generated when the piezoelectric element is driven, and a signal generation circuit that generates a first drive signal applied to a first piezoelectric element to be inspected among a plurality of piezoelectric elements corresponding to the plurality of hollow portions and a second drive signal applied to a second piezoelectric element different from the first piezoelectric element. The second drive signal maintains a state where a second vibration portion including the second piezoelectric element and the flexible plane corresponding to the second piezoelectric element is deformed during at least a detection period in which the inspection mechanism performs inspection based on vibration caused when a first vibration portion including the first piezoelectric element and the flexible plane corresponding to the first piezoelectric element is driven.

According to this invention, it is possible to change a tensile force applied to the flexible plane of the first vibration portion by causing the second vibration portion to be in a deformed state during the detection period, so that it is possible to change a vibration period of the first vibration portion. Therefore, when a unique vibration period of the first vibration portion is different from a design target value (reference vibration period) due to, for example, manufacturing variation and the like, it is possible to adjust (correct) the vibration period so as to be close to the target value by using the second vibration portion. Thereby, it is possible to improve the detection accuracy of ejection abnormality.

In the configuration described above, it is preferable to employ a configuration where the second drive signal is maintained at a constant adjustment voltage during the detection period.

According to this configuration, the second vibration portion does not vibrate and maintains a constant shape in a period of time in which the first vibration portion vibrates in the detection period, so that it is suppressed that the vibration of the second vibration portion is superimposed on the vibration of the first vibration portion to cause adverse effects.

Further, in the configuration described above, it is preferable to employ a configuration where a temperature detection mechanism that detects temperature of the liquid ejecting head is included and the adjustment voltage varies according to the temperature detected by the temperature detection mechanism.

According to this configuration, even when the vibration period of the first vibration portion varies from the reference vibration period according to variation of temperature, it is possible for the second vibration portion to adjust the vibration period so as to be close to the reference vibration period.

Further, in the configuration described above, it is preferable to employ a configuration where the second drive signal has a plurality of different adjustment voltages.

According to this configuration, it is possible to easily select a more suitable adjustment voltage.

Further, in the configuration described above, it is preferable to employ a configuration where the second drive signal generates a waveform element that amplifies vibration of the first vibration portion by vibrating the second vibration portion during a vibration generation period in which the first vibration portion is vibrated by the first drive signal before the detection period.

According to this configuration, it is possible to amplify the vibration of the first vibration portion, so that it is possible to further improve the detection accuracy of ejection abnormality.

Further, in the configuration described above, it is preferable to employ a configuration where the first vibration portion and the second vibration portion are adjacent to each other with a wall delimiting the hollow portions in between.

According to this configuration, it is possible to more efficiently change a tensile force which is applied to the flexible plane of the first vibration portion by deformation of the second vibration portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments for carrying out the invention will be described with reference to the drawings. n the embodiments described below, there are various limitations as preferable concrete examples of the invention. However, the scope of the invention is not limited to the embodiments as long as a description limiting the invention is not given in particular in the description below. In the description below, as the liquid ejecting apparatus of the invention, an ink jet type recording apparatus (hereinafter referred to as a printer 1) in which an ink jet recording head (hereinafter referred to as a recording head 2) that is a type of a liquid ejecting head is mounted will be described as an example.

Figure 1:
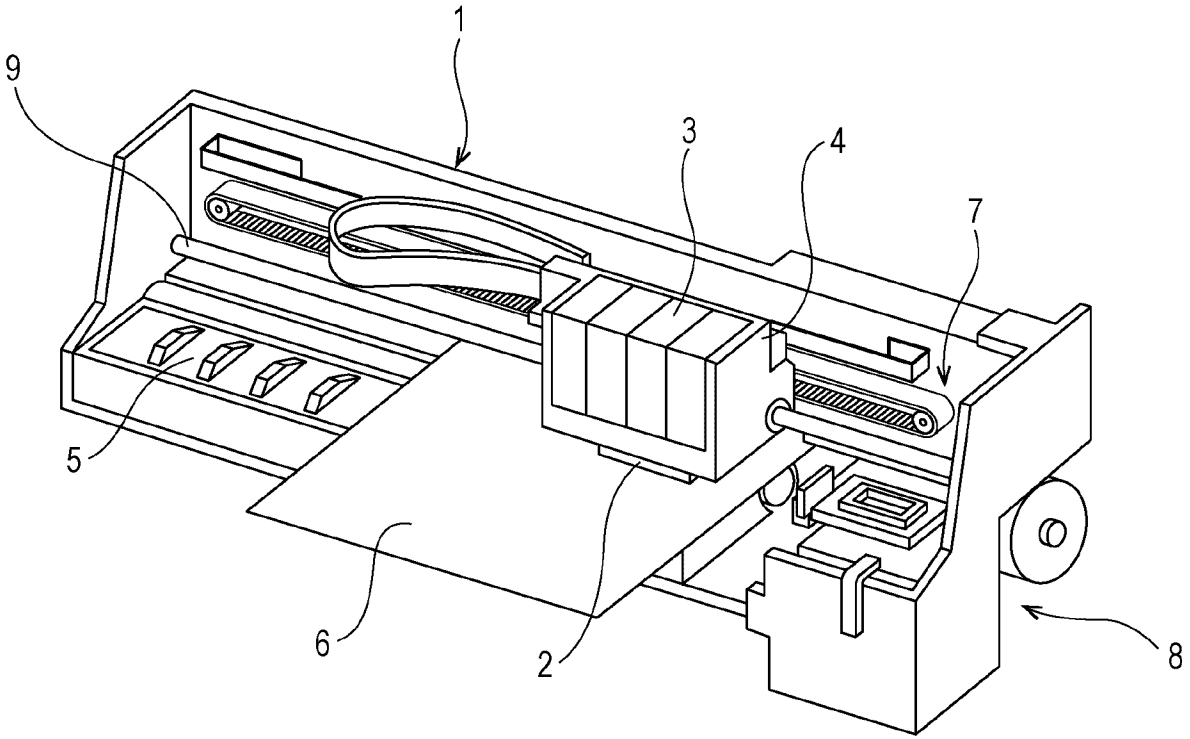
FIG. 1 is a perspective view for explaining a configuration of a printer, which is one form of a liquid ejecting apparatus.

FIG. 1 is a perspective view showing a configuration of the printer 1. The printer 1 includes a carriage 4 where the recording head 2 is mounted and an ink cartridge 3 that is a type of a liquid supply source that retains ink (a type of liquid) is detachably attached, a platen 5 that is arranged below the recording head 2 that is performing a recording operation, a carriage moving mechanism 7 that reciprocates the carriage 4 in a paper width direction of a recording paper 6 (a type of a recording medium or a liquid landing target), that is, in a main scanning direction, and a paper feed mechanism 8 that transports the recording paper 6 in a sub-scanning direction crossing (perpendicular to) the main scanning direction.

The carriage 4 is attached in a state of being pivotally supported by a guide rod 9 provided along the main scanning direction and reciprocates in the main scanning direction along the guide rod 9. The printer 1 is configured to be able to perform so-called bidirectional recording which records characters and images on the recording paper 6 in both directions including a forward direction in which the carriage 4 moves from a home position that is a standby position of the recording head 2 provided at one end (right side in FIG. 1) of a moving range of the carriage 4 to the other end opposite to the one end and a backward direction in which the carriage 4 returns from the other end to the home position. It is also possible to employ a configuration in which the ink cartridge 3 is arranged in a main body of the printer 1 instead of the carriage 4 and ink in the ink cartridge 3 is supplied to the recording head 2 through an ink supply tube.

Figure 2:
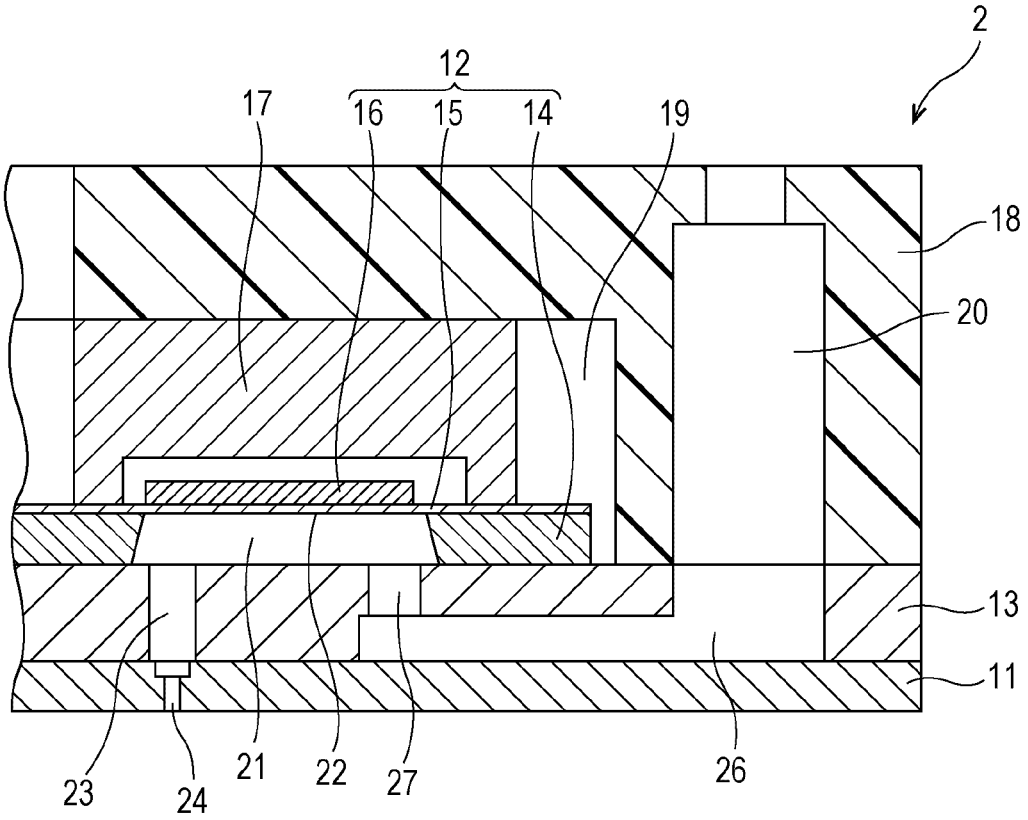
FIG. 2 is a cross-sectional view for explaining a configuration of a recording head, which is one form of a liquid ejecting head.

FIG. 2 is a cross-sectional view showing an example of the recording head 2. For convenience of explanation, a lamination direction of members is defined as a vertical direction. The recording head 2 of the present embodiment is formed by laminating a plurality of substrates, specifically, a nozzle plate 11, a communicating substrate 13, and an actuator substrate 12 in this order and bonding and unitizing the substrates with an adhesive. The actuator substrate 12 is formed by laminating a pressure chamber forming substrate 14 (a type of a substrate in the invention), a vibrating plate 15, a piezoelectric element 16, and the like. A sealing plate 17 that covers and protects the piezoelectric element 16 is laminated on the actuator substrate 12 and a laminated body of these is attached to a case 18, so that the recording head 2 is formed.

The case 18 is a box-shaped member made of synthetic resin. A housing hollow portion 19 that is recessed in a rectangular parallelepiped shape from a lower surface of the case 18 to middle of the case 18 in a height direction is formed on the lower surface of the case 18. When the communicating substrate 13 of the laminated body is bonded to the lower surface, the actuator substrate 12 (the pressure chamber forming substrate 14, the vibrating plate 15, the piezoelectric element 16, and the sealing plate 17) of the laminated body is housed in the housing hollow portion 19. An ink introduction passage 20 is formed in the case 18. Ink from the ink cartridge 3 is introduced to a common liquid chamber 26 through the ink introduction passage 20.

The pressure chamber forming substrate 14 of the present embodiment is made of a silicon single crystal substrate (hereinafter, also referred to as simply a silicon substrate). In the pressure chamber forming substrate 14, a plurality of pressure chamber hollow portions, each of which is a pressure chambers 21 that is a type of a hollow portion in the invention, are formed. An opening portion on one side (upper surface side) of the pressure chamber hollow portion in the pressure chamber forming substrate 14 is sealed by the vibrating plate 15. The communicating substrate 13 is bonded to a surface of the pressure chamber forming substrate 14 opposite to the vibrating plate 15, and an opening portion on the other side of the pressure chamber hollow portion is sealed by the communicating substrate 13. Thereby, the pressure chamber 21 is delimited and formed. Here, a portion where the upper opening of the pressure chamber 21 is sealed by the vibrating plate 15 is a flexible plane 22 that is displaced when the piezoelectric element 16 (active portion) is driven. It is also possible to employ a configuration in which the pressure chamber forming substrate 14 and the flexible plane 22 are integrated together. Specifically, etching is performed from the lower surface of the pressure chamber forming substrate 14 to leave a thin portion whose thickness is thin on the supper surface, so that the pressure chamber hollow portion is formed. It is possible to employ a configuration in which the thin portion functions as the flexible plane 22.

The pressure chamber 21 of the present embodiment is a hollow portion elongated in a direction (second direction) crossing a direction in which nozzles 24 are arranged side by side in parallel, that is, a nozzle row direction (first direction). One end portion of the pressure chamber 21 in the second direction communicates with the nozzle 24 through a nozzle communicating port 23 of the communicating substrate 13. The other end portion of the pressure chamber 21 in the second direction communicates with the common liquid chamber 26 through an individual communicating port 27 of the communicating substrate 13. A plurality of pressure chambers 21 are arranged side by side in parallel while being separated by partition walls 25 (see FIG. 5 and the like) along the nozzle row direction (first direction) corresponding to each nozzle 24.

The communicating substrate 13 is a plate member made of a silicon substrate in the same manner as the pressure chamber forming substrate 14. In the communicating substrate 13, a hollow portion to be the common liquid chamber 26 (also called a reservoir or a manifold) provided in common for a plurality of pressure chambers 21 of the pressure chamber forming substrate 14 is formed by anisotropic etching. The common liquid chamber 26 is a hollow portion elongated along a direction in which the pressure chambers 21 are arranged side by side in parallel (that is, the first direction). As described above, the common liquid chamber 26 communicates with each pressure chamber 21 through the individual communicating port 27.

The nozzle plate 11 is a plate member in which a plurality of nozzles 24 are provided in a row shape. In the present embodiment, the nozzle row is formed by providing a plurality of nozzles 24 in a row at a pitch corresponding to a dot formation density. The nozzle plate 11 of the present embodiment is made of a silicon substrate, and the cylindrically shaped nozzles 24 are formed by dry-etching the substrate. Corresponding to each nozzle 24, an ink flow path is formed from the common liquid chamber 26 described above to the nozzle 24 through the individual communicating port 27, the pressure chamber 21, and the nozzle communicating port 23.

The piezoelectric element 16 is arranged on an outer surface of the vibrating plate 15, which is opposite to the pressure chamber 21, corresponding to each pressure chamber 21. The illustrated piezoelectric element 16 is a piezoelectric element of a so-called flexural vibration mode and is formed by a drive electrode and a common electrode which are not shown in the drawings and which sandwich a piezoelectric layer. When a drive signal (drive pulse) is applied to the drive electrode of the piezoelectric element 16, an electric field according to a voltage difference is generated between the drive electrode and the common electrode. The electric field is applied to the piezoelectric layer and the piezoelectric layer is deformed according to the strength of the applied electric field. Specifically, the higher the voltage of the drive electrode is, the more a central portion in the width direction (nozzle row direction) of the piezoelectric layer bends into the pressure chamber 21 (toward the nozzle plate 11), so that the flexible plane 22 of the vibrating plate 15 is deformed so as to decrease the volume of the pressure chamber 21. On the other hand, the lower the voltage of the drive electrode is (the closer to 0 the voltage is), the more a central portion in the short length direction of the piezoelectric layer bends away from the nozzle plate 11, so that the vibrating plate 15 is deformed so as to increase the volume of the pressure chamber 21.

Figure 3:
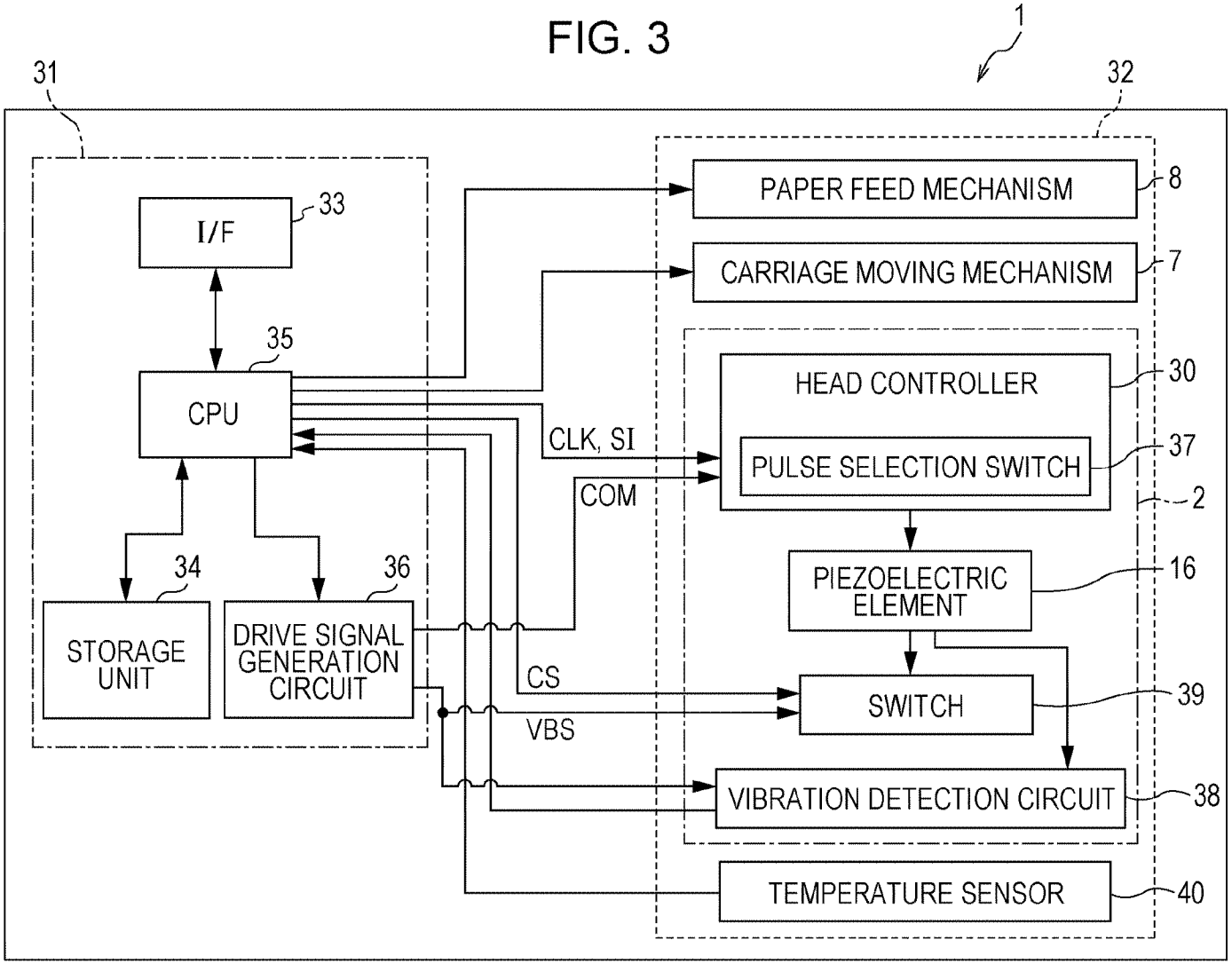
FIG. 3 is a block diagram showing an example of an electrical configuration of the printer.

FIG. 3 is a block diagram showing an electrical configuration of the printer 1. The printer 1 of the present embodiment includes a printer controller 31 and a print engine 32. The printer controller 31 includes an external interface (external I/F) 33 to which print data and the like are inputted from external apparatuses such as a computer and a mobile phone, a storage unit 34 that stores a control program and the like and various data and the like for various controls, a CPU 35 that performs integrated control of each unit according to the control program stored in the storage unit 34, and a drive signal generation circuit 36 (a type of a signal generation circuit in the invention) that generates a drive signal to be supplied to the recording head 2. The print engine 32 has the recording head 2, the carriage moving mechanism 7, the paper feed mechanism 8, a vibration detection circuit 38, a temperature sensor 40 (corresponding to a temperature detection mechanism in the invention), and the like.

The drive signal generation circuit 36 outputs a drive signal COM to be applied to the drive electrode of the piezoelectric element 16 and also outputs a common DC voltage VBS to be applied to the common electrode of the piezoelectric element 16. The drive signal generation circuit 36 is electrically connected to the drive electrode of the piezoelectric element 16 through a pulse selection switch 37 provided for each piezoelectric element 16. Further, the drive signal generation circuit 36 is electrically connected to the common electrode of the piezoelectric element 16 through a switch 39 provided in common for each piezoelectric element 16 belonging to the same nozzle row and the vibration detection circuit 38 connected in parallel with the switch 39.

A head controller 30 of the recording head 2 performs ink ejection control based on gradation data SI transmitted from the printer controller 31. In the present embodiment, the gradation data SI including two bits is transmitted in synchronization with a clock signal and sequentially inputted into a shift register and a latch circuit (that are not shown in the drawings) of the head controller 30. Then, the latched gradation data SI is outputted to a decoder not shown in the drawings. The decoder generates pulse gradation data for selecting a drive pulse included in the drive signal COM based on a high-order bit group and a low-order bit group of recording data.

The drive signal COM from the drive signal generation circuit 36 is supplied to the head controller 30. The drive signal COM is inputted into the pulse selection switch 37 of the head controller 30. The drive electrode of the piezoelectric element 16 is connected to the output side of the pulse selection switch 37. The pulse selection switch 37 selectively applies the drive pulse included in the drive signal COM to the drive electrode of the piezoelectric element 16 based on the pulse gradation data described above. The pulse selection switch 37 functions as a switching mechanism that switches a connection state or a disconnection state between the drive signal generation circuit 36 and the piezoelectric element 16 when inspection processing described later is performed.

The vibration detection circuit 38 connected in parallel with the switch 39 is provided to the common electrode side of the piezoelectric element 16. The switch 39 is switch-controlled according to a switching signal CS outputted from the CPU 35. The switch 39 is turned off during a detection period described later and is turned on during the other period. The vibration detection circuit 38 includes a detection resistor and an A/D converter which are not shown in the drawings and outputs an electromotive force signal of the piezoelectric element 16 based on vibration (residual vibration during the detection period) generated in ink in the pressure chamber when the piezoelectric element 16 is driven by an inspecting drive pulse Pd shown in FIG. 4 to the printer controller 31 as a detection signal. The CPU 35 of the printer controller 31 inspects presence or absence of abnormality of ink ejection from the nozzles 24 based on the electromotive force signal outputted from the vibration detection circuit 38. Therefore, the vibration detection circuit 38 and the CPU 35 function as an inspection mechanism of the invention and perform inspection on the ink ejection from the nozzles 24 by detecting vibration of ink in the pressure chamber by using the piezoelectric element 16 as a vibration sensor.

The printer 1 according to the invention is configured to perform inspection processing of the recording head 2 so as to detect ejection abnormality due to thickening of ink and the like. As an inspection execution condition, it is possible to use a condition that a usage time of the printer 1 (for example, an integrated value of time while the printer 1 performs an operation to eject ink from the nozzles 24), the number of ejection times (for example, the sum of the numbers of ejection times of all the nozzles or an integrated value of average values of the numbers of ejection times of all the nozzles), or the total number of recording media that have been printed exceeds a predetermined determination value. Further, a case where execution of the inspection processing is instructed by a user through a printer driver or the like may be used as the inspection execution condition. When the inspection execution condition is established, the printer controller 31 proceeds to the inspection processing, selects a nozzle to be inspected from all the nozzles 24 of the recording head 2, and performs the inspection processing based on an electromotive force generated in the piezoelectric element 16 corresponding to the nozzle to be inspected when applying, for example, the inspecting drive pulse Pd shown in FIG. 4 to the piezoelectric element 16. For example, the nozzle to be inspected may be sequentially selected from a nozzle located at one end of a nozzle row to a nozzle located at the other end of the nozzle row, or for example, the nozzle to be inspected may be selected when a user specifies a nozzle 24 suspected of ejection abnormality due to thickening of ink.

Figure 4:
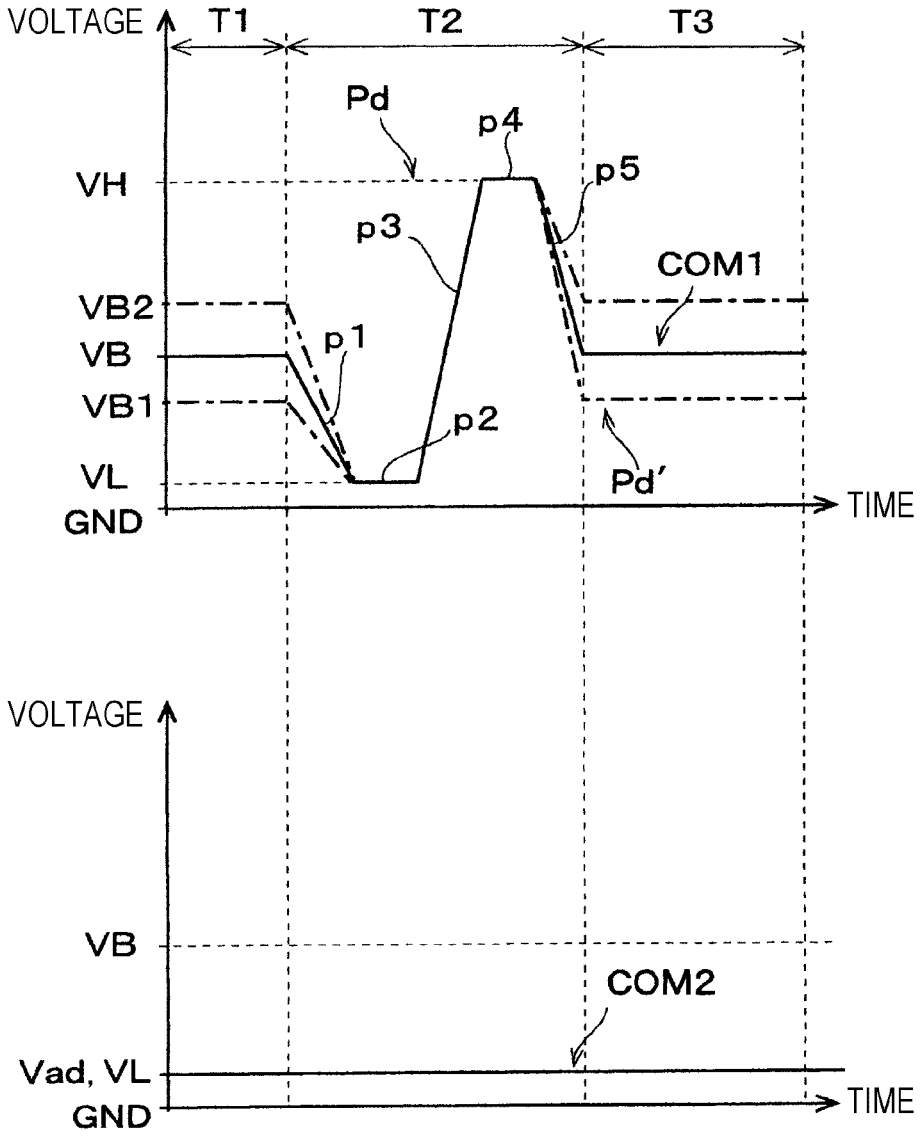
FIG. 4 is a waveform chart for explaining a configuration of a drive signal.

As the inspection drive pulse described above, a pulse of various waveforms can be employed if the pulse can give pressure variation to the ink in the pressure chamber 21. However, in the present embodiment, the inspecting drive pulse Pd shown in FIG. 4 is used. Further, in the present embodiment, when an inspecting drive signal COM1 (a type of a first drive signal in the invention) is supplied to the piezoelectric element 16 to be inspected (corresponding to a first piezoelectric element in the invention) corresponding to the nozzle 24 to be inspected and inspection is performed by the piezoelectric element 16, an adjusting drive signal COM2 (a type of a second drive signal in the invention) is supplied to another piezoelectric element 16 (corresponding to a second piezoelectric element in the invention) different from the piezoelectric element 16 to be inspected, so that a vibration period of the piezoelectric element 16 to be inspected and the flexible plane 22 (hereinafter referred to as an inspection target vibration portion) corresponding to the piezoelectric element 16 to be inspected can be adjusted.

FIG. 4 is a waveform chart for explaining a configuration of the inspecting drive signal COM1 and the adjusting drive signal COM2. The upper waveform indicates the inspecting drive signal COM1 and the lower waveform indicates the adjusting drive signal COM2. The inspecting drive signal COM1 of the present embodiment is divided into three periods, which are a first period T1, a second period T2, and a third period T3. The inspecting drive pulse Pd shown in FIG. 4 is generated in the second period T2. In the first period T1 and the third period T3 of these periods T1 to T3, the voltage of the inspecting drive signal COM1 is constant at a reference voltage VB (standby voltage). The beginning and the end of the inspecting drive pulse Pd in the second period T2 are set to the reference voltage VB. The reference voltage VB is a voltage corresponding to a volume from which the pressure chamber 21 expands or contracts. As described later, when the reference voltage VB is applied to the piezoelectric element 16, the piezoelectric element 16 and the flexible plane 22 corresponding to the piezoelectric element 16 bend toward the inside of the pressure chamber 21 (toward the nozzle plate 11). The second period T2 is a vibration generation period in which pressure vibration is generated in the ink in the pressure chamber 21. The third period T3 is a detection period in which the pressure vibration (residual vibration) of ink generated in the second period T2 is detected by the vibration detection circuit 38. The inspecting drive pulse Pd generated in the second period T2 includes a preliminary expansion element p1, an expansion hold element p2, a contraction element p3, a contraction hold element p4, and a return element p5. The preliminary expansion element p1 is a waveform element whose voltage changes toward a ground voltage GND from the reference voltage VB to an expansion voltage VL lower than the reference voltage VB. The expansion hold element p2 is a waveform element which holds the expansion voltage VL that is an end voltage of the preliminary expansion element p1 for a certain period of time. The contraction element p3 is a waveform element whose voltage changes toward positive side from the expansion voltage VL to a contraction voltage VH through the reference voltage VB. The contraction hold element p4 is a waveform element which holds the contraction voltage VH for a certain period of time. The return element p5 is a waveform element whose voltage returns from the contraction voltage VH to the reference voltage VB. The voltage of the beginning of the inspecting drive pulse Pd (the beginning of the preliminary expansion element p1) and the voltage of the end of the inspecting drive pulse Pd (the end of the return element p5) are set to the reference voltage VB. As the inspecting drive pulse Pd, a drive pulse for printing can be used or a pulse dedicated to the inspection processing can be used.

When the inspecting drive pulse Pd configured as described above is applied to the piezoelectric element 16 of the inspection target vibration portion, first, the inspection target vibration portion is bent in a direction away from the nozzle plate 11 by the preliminary expansion element p1, and accordingly the pressure chamber 21 expands from a reference volume corresponding to the reference voltage VB to an expansion volume corresponding to the expansion voltage VL. An expansion state of the pressure chamber 21 is maintained for a certain period of time by the expansion hold element p2. After a hold by the expansion hold element p2, the inspection target vibration portion is bent inside the pressure chamber 21 (toward the nozzle plate 11) by the contraction element p3. Accordingly, the pressure chamber 21 is rapidly contracted from the expansion volume to a contraction volume corresponding to the contraction voltage VH. Thereby, the ink in the pressure chamber 21 is pressurized and the pressure vibration is generated in the ink. Subsequently, the return element p5 is applied, so that the inspection target vibration portion returns to a steady position corresponding to the reference voltage VB. Accordingly, the pressure chamber 21 expands and returns to the reference volume corresponding to the reference voltage VB. When the inspection target vibration portion is driven by the inspecting drive pulse Pd of the present embodiment, ink may be or may not be ejected from the nozzle 24.

On the other hand, the adjusting drive signal COM2 is a drive signal that is constant at an adjustment voltage Vad. That is, the adjusting drive signal COM2 is constant at an adjustment voltage Vad over the entire period from the period T1 to the period T3. In the present embodiment, the adjustment voltage Vad is set to the expansion voltage VL of the inspecting drive signal COM1. However, the adjustment voltage Vad may be a voltage different form the expansion voltage VL according to the degree of adjustment. The adjusting drive signal COM2 is a signal that maintains a deformed state of an adjusting vibration portion constant by continuously applying a constant voltage (adjustment voltage Vad) to the adjusting vibration portion described later at least in the detection period (period T3) of the inspection target vibration portion. The adjusting drive signal COM2 is not limited to a signal formed from only the adjustment voltage Vad, but may have an element where a voltage varies as described below.

Here, after the inspection target vibration portion is driven in the period T2 by the inspecting drive pulse Pd of the inspecting drive signal COM1, a constant reference voltage VB is continuously applied to the piezoelectric element 16 of the inspection target vibration portion. However, the inspection target vibration portion is vibrated by the pressure vibration (residual vibration) generated in the ink in the pressure chamber 21. Thereby, an electromotive force based on the vibration is generated in the piezoelectric element 16 of the inspection target vibration portion. The vibration detection circuit 38 obtains an electromotive force signal Sc (detection signal) of the piezoelectric element 16. In the case of abnormality such as a case of a so-called missing dot where ink is not ejected from the nozzle 24 and a case where even if ink is ejected from the nozzle 24, the amount of ink or a flying speed of ink is extremely lower than those ejected from a normal nozzle 24, a periodical component and an amplitude component of the aforementioned detection signal are different from a vibration period (hereinafter, reference vibration period) and an amplitude of normal time which are acquired in advance. A detection method of ejection abnormality based on the electromotive force signal Sc has been publicly known, so that detailed description will be omitted. However, it is possible to detect ejection abnormality due to ink thickening and/or bubbles by the detection method.

By the way, the aforementioned reference vibration period is a value acquired under a predetermined condition (temperature, humidity, and the like) in an inspection stage before the printer 1 is shipped from a factory. However, the recording head 2 of the present embodiment is formed by bonding a plurality of substrates with an adhesive or the like, so that due to, for example, manufacturing variation and extrusion of adhesive to a flow path (pressure chamber 21), the vibration period of vibration portion corresponding to the nozzle 24 is different from the reference vibration period depending on the nozzle 24. As a result, the vibration periods may vary between the nozzles 24. Therefore, the printer 1 according to the invention is configured so that the degree of deformation (amount of bending/magnitude of bending) of the adjusting vibration portion is adjusted by the adjusting drive signal COM2 (second drive signal) when the piezoelectric element 16 of the inspection target vibration portion is driven and thereby inspection is performed in a state where the vibration period of the inspection target vibration portion is matched to the reference vibration period. A difference from the reference vibration period of each piezoelectric element 16 is acquired in advance in an inspection stage before shipment from a factory and stored in, for example, the storage unit 34. When the piezoelectric element 16 is driven as the inspection target vibration portion, the adjustment voltage Vad of the adjusting drive signal COM2 is set based on the difference stored in the storage unit 34.

Figure 5:
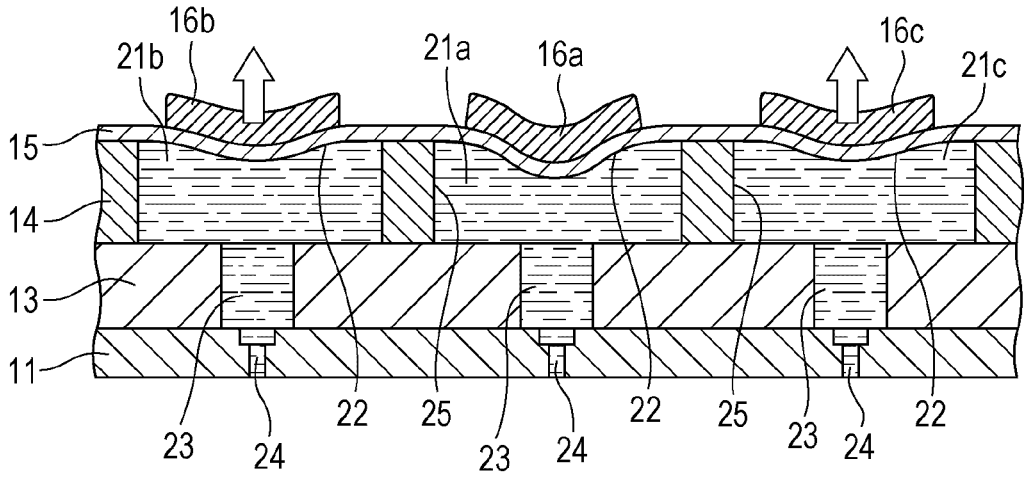
FIG. 5 is a schematic diagram of a recording head for explaining inspection processing.
Figure 6:
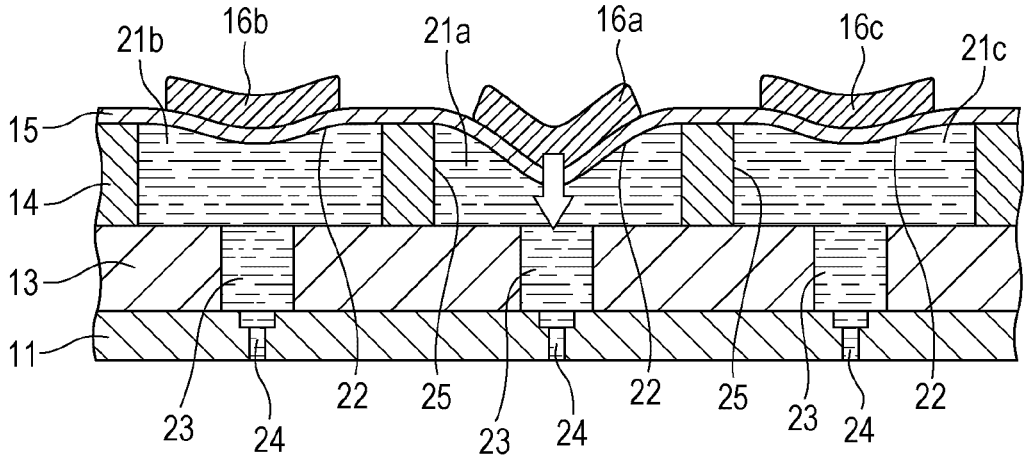
FIG. 6 is a schematic diagram of the recording head for explaining the inspection processing.
Figure 7:
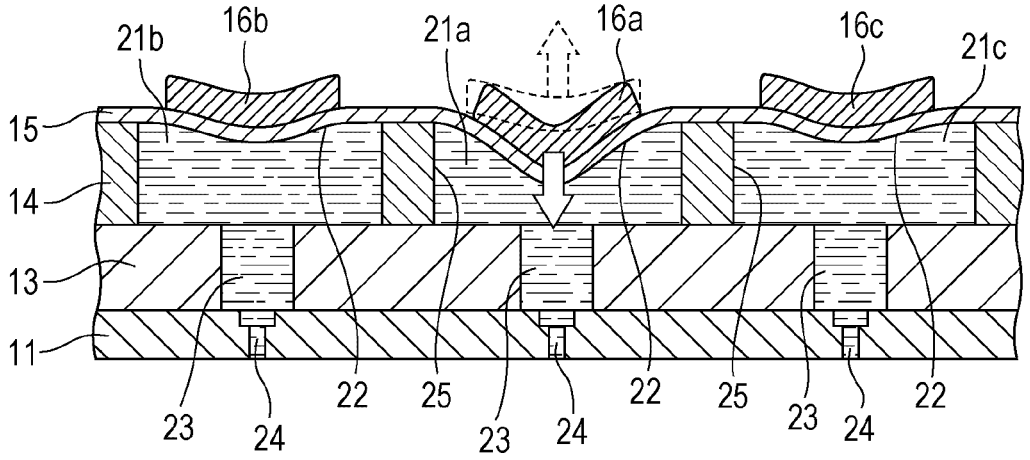
FIG. 7 is a schematic diagram of the recording head for explaining the inspection processing.

FIGS. 5 to 7 are schematic diagrams of the recording head 2 for explaining the inspection processing and are cross-sectional views in a nozzle row direction. Here, among the three piezoelectric elements 16*a* to 16*c* adjacent to each other shown in FIGS. 5 to 7, the piezoelectric element 16*a* located at the center is an inspection target piezoelectric element (corresponding to a first piezoelectric element in the invention), and the inspection target piezoelectric element and the flexible plane 22 corresponding to the inspection target piezoelectric element are the inspection target vibration portion (corresponding to a first vibration portion in the invention). The piezoelectric elements 16*b* and 16*c* adjacent to the piezoelectric element 16*a* with the partition wall 25, which is located at both sides of the piezoelectric element 16*a*, in between are adjusting piezoelectric elements (corresponding to second piezoelectric elements in the invention) that adjust the vibration period of the inspection target vibration portion, and the adjusting piezoelectric element and the flexible plane 22 corresponding to the adjusting piezoelectric element are the adjusting vibration portion (corresponding to a second vibration portion in the invention).

As shown in FIG. 5, in the first period T1, the reference voltage VB of the inspecting drive signal COM1 is applied to the piezoelectric element 16*a* which is the inspection target vibration portion, and the adjustment voltage Vad of the adjusting drive signal COM2 is applied to the piezoelectric elements 16*b* and 16*c*. In the first period T1, the piezoelectric element 16*a* which is the inspection target vibration portion is bending toward the inside of the pressure chamber 21 (toward the nozzle plate 11) corresponding to the reference voltage VB. On the other hand, the central portion in the width direction of the adjusting vibration portion (the piezoelectric elements 16*b* and 16*c* and the flexible planes 22 thereof) to which the adjustment voltage Vad is applied bends away from the nozzle plate 11 (in a direction indicated by void arrows in FIG. 5), and becomes nearly in parallel with the upper opening surface of the pressure chamber 21 (slightly bends into the pressure chamber 21 instead of becoming in parallel with the upper opening surface). In this way, the adjustment voltage Vad of the adjusting drive signal COM2 is continuously applied to the piezoelectric elements 16*b* and 16*c* and the amount of bending of the adjusting vibration portion is adjusted. The adjusting vibration portions bend, so that the flexible plane 22 corresponding to the inspection target vibration portion is pulled from both sides (from the pressure chambers 21*b* and 21*c* on both adjacent sides) and a tensile force (tension) is applied to the flexible plane 22. The amount of bending of the adjusting vibration portion is adjusted, so that the magnitude of the tension changes.

Specifically, when the tension applied to the flexible plane 22 of the inspection target vibration portion increases, the hardness (compliance C [mm/N]) of the flexible plane 22 of the inspection target vibration portion becomes greater than the original hardness of the flexible plane 22 of the inspection target vibration portion of when the inspection target vibration portion is independently driven. On the other hand, when the tension applied to the flexible plane 22 of the inspection target vibration portion decreases, the hardness of the flexible plane 22 of the inspection target vibration portion becomes smaller than the original hardness of the flexible plane 22 of the inspection target vibration portion of when the inspection target vibration portion is independently driven. The vibration period of the inspection target vibration portion changes according to the compliance C. In other words, the vibration period of the inspection target vibration portion changes according to the change of hardness of the flexible plane 22 of the inspection target vibration portion. For example, when it is assumed that the tension applied to the flexible plane 22 of the inspection target vibration portion becomes the smallest when the adjustment voltage Vad applied to the piezoelectric element 16 of the adjusting vibration portion is the ground voltage (GND), the higher the adjustment voltage Vad, the greater the tension applied to the flexible plane 22 and the smaller the compliance C, so that the vibration period of the inspection target vibration portion further decreases. The closer the adjustment voltage Vad of the adjusting drive signal COM2 is to the ground voltage (GND), the smaller the tension applied to the flexible plane 22 and the greater the compliance C, so that the vibration period of the inspection target vibration portion further increases. Therefore, when a unique vibration period of each vibration portion including the piezoelectric element 16 and the flexible plane 22 corresponding to the piezoelectric element 16 is different from the reference vibration period due to manufacturing variation and the like, it is possible for the adjusting vibration portion to adjust (correct) the unique period so that the unique period becomes close to the reference vibration period. In the present embodiment, the inspection target vibration portion and the adjusting vibration portion are adjacent to each other with one partition wall 25 in between, so that it is possible to more efficiently adjust the tensile force applied to the flexible plane 22 of the inspection target vibration portion, which is caused by deformation of the adjusting vibration portion.

As shown in FIG. 6, in the second period T2 which is the vibration generation period, the inspecting drive pulse Pd of the inspecting drive signal COM1 is applied to the piezoelectric element 16*a* of the inspection target vibration portion and the adjustment voltage Vad of the adjusting drive signal COM2 is continuously applied to the piezoelectric elements 16*b* and 16*c* of the adjusting vibration portions. Then, the inspection target vibration portion vibrates according to the inspecting drive pulse Pd, so that the pressure vibration is generated in the ink in the pressure chamber 21*a* corresponding to the inspection target vibration portion. Next, in the third period T3 which is the detection period, the constant reference voltage VB is continuously applied to the piezoelectric element 16*a* of the inspection target vibration portion and the constant adjustment voltage Vad is continuously applied to the piezoelectric elements 16*b* and 16*c* of the adjusting vibration portions. Then, as shown in FIG. 7, the inspection target vibration portion is freely-vibrated by the pressure vibration (residual vibration) generated in the ink in the pressure chamber 21*a* corresponding to the inspection target vibration portion. Thereby, an electromotive force based on the free vibration is generated in the piezoelectric element 16 of the inspection target vibration portion. In the third period T3, the vibration detection circuit 38 obtains an electromotive force signal Sc (detection signal) of the piezoelectric element 16*a* of the inspection target vibration portion. Then, the CPU 35 determines presence or absence of abnormality of ink ejection of the nozzle 24 to be inspected by comparing periodical components, amplitude components, and the like between the electromotive force signal Sc and the reference vibration period. In this way, in the printer 1 according to the invention, the inspection is performed in a state in which the vibration period of the inspection target vibration portion is set to the reference vibration period. Therefore, it is possible to improve inspection accuracy. Further, in the present embodiment, the adjusting vibration portion does not vibrate in a period of time in which the inspection target vibration portion vibrates in the detection period and a constant shape of the adjusting vibration portion is maintained, so that it is suppressed that the vibration of the adjusting vibration portion is superimposed on the vibration of the inspection target vibration portion to cause adverse effects.

By the way, the viscosity of the ink changes when the environmental temperature (the temperature around (inside) the printer 1, in particular, the temperature near the nozzle 24) changes, and the vibration period of the ink during inspection also changes according to the viscosity of the ink, so that the inspecting drive signal COM1 is corrected according to the environmental temperature detected by the temperature sensor 40. More specifically, in a configuration where the temperature when the reference vibration period is acquired (for example, 25° C.) is defined as a reference temperature and the reference voltage VB is set for the inspecting drive signal COM1 at the reference temperature, when the temperature becomes higher than the reference temperature (for example, the temperature becomes 40° C.), as shown in FIG. 4, the reference voltage VB is corrected to the reference voltage VB1 lower than the reference voltage VB. When the temperature becomes lower than the reference temperature (for example, the temperature becomes 15° C.), the reference voltage VB is corrected to the reference voltage VB2 higher than the reference voltage VB at the reference temperature. When the value of the reference voltage VB which is a voltage at the beginning and the end of the inspecting drive pulse Pd changes according to the temperature, the degree of deformation of the inspection target vibration portion (in particular, the degree of deformation in the third period T3 which is the inspection period) also changes, so that even when the vibration period of the inspection target vibration portion is the same as the reference vibration period at the reference temperature, the vibration period changes from the reference vibration period due to a temperature change. Therefore, a difference between the vibration period of each piezoelectric element 16 and the reference vibration period is acquired for each temperature and stored in the storage unit 34, and when the piezoelectric element 16 is driven as the inspection target vibration portion, temperature is acquired by the temperature sensor 40 and the adjustment voltage Vad of the adjusting drive signal COM2 is set based on the difference stored in the storage unit 34. Thereby, even when the environmental temperature changes, the inspection is performed in a state in which a unique vibration period of the inspection target vibration portion is set to the reference vibration period. Therefore, it is possible to improve inspection accuracy.

In the present embodiment, a configuration is illustrated where the tension applied to the inspection target vibration portion is adjusted by setting the adjustment voltage Vad lower than the reference voltage VB. However, the tension adjustment is not limited to this, and it is possible to employ a configuration where the tension applied to the inspection target vibration portion is adjusted by setting the adjustment voltage Vad higher than the reference voltage VB. That is, in this case, the higher the adjustment voltage Vad, the more the central portion in the width direction of the adjusting vibration portion bends into the pressure chamber 21 (toward the nozzle plate 11). Thereby, a greater tension is applied to the inspection target vibration portion.

The adjusting vibration portion does not necessarily have to be used to eject ink. That is, the adjusting vibration portion only have to include at least the piezoelectric element 16, the flexible plane 22, and the pressure chamber 21. The pressure chamber 21 may be a so-called dummy pressure chamber that does not communicate with the nozzle 24. The size of the dummy pressure chamber need not be the same as that of the pressure chamber 21 used to eject ink. Further, the dummy pressure chamber need not be filled with ink, but may be filled with air. In the first embodiment described above, a configuration is illustrated where the nozzles 24 are provided in a row shape and accordingly the pressure chambers 21 are arranged side by side in parallel. However, the configuration is not limited to this, and the invention can be applied to, for example, a configuration where the pressure chambers and the vibration portions corresponding to the pressure chambers are arranged in a matrix shape. Among the vibration portions arranged in this way, a vibration portion located in a position where the vibration portion can apply tension to the inspection target vibration portion can function as the adjusting vibration portion.

Figure 8:
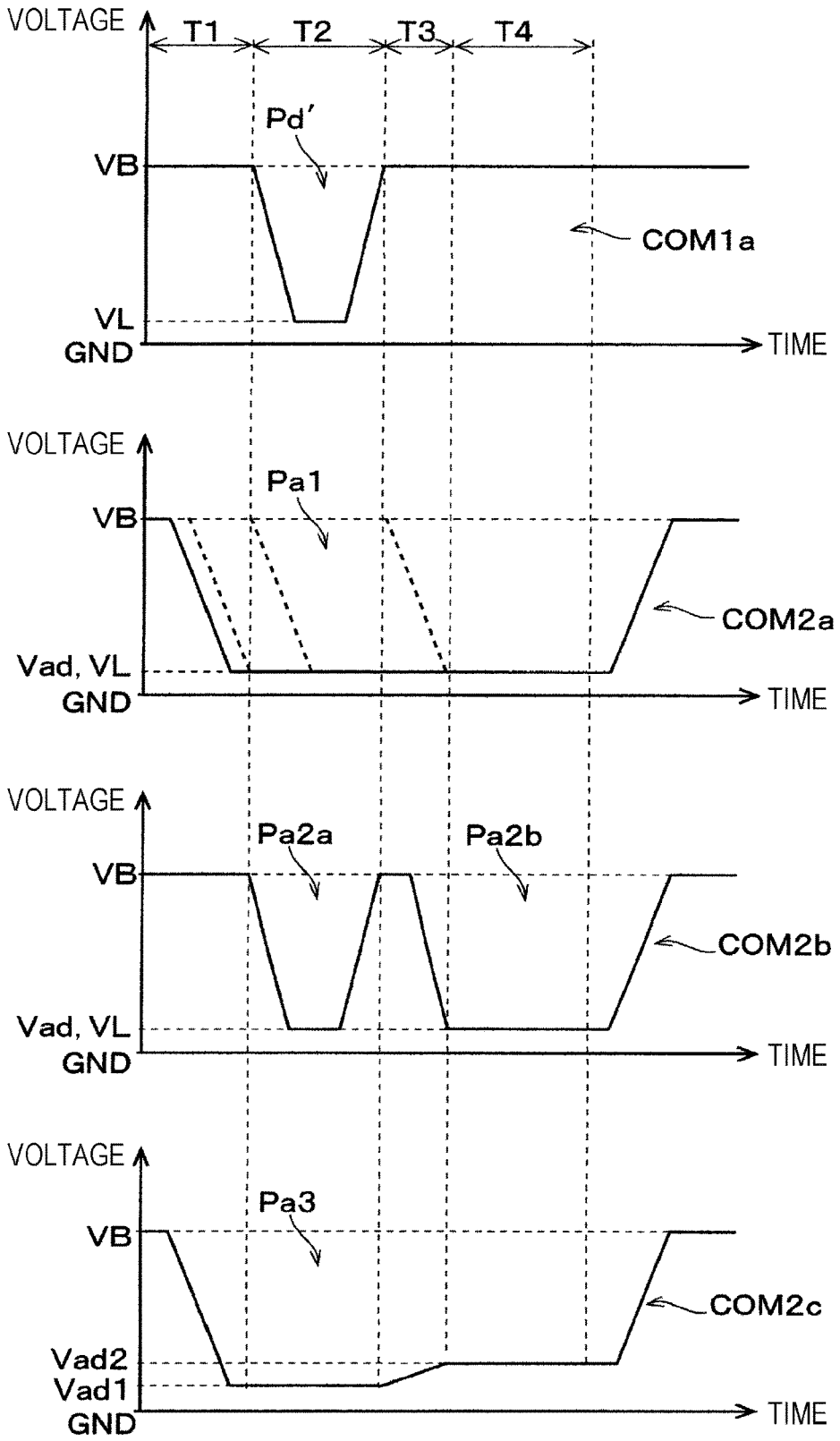
FIG. 8 is a waveform chart for explaining a configuration of a drive signal in a second embodiment.

FIG. 8 is a waveform chart for explaining a configuration of an inspecting drive signal COM1*a* and adjusting drive signals COM2*a* to 2*c* in a second embodiment. The inspecting drive signal COM1*a* shown in the uppermost section in FIG. 8 is divided into four periods, which are a first period T1, a second period T2, a third period T3 and a fourth period T4. An inspecting drive pulse Pd' is generated in the second period T2. In the first period T1, the third period T3, and the fourth period T4, the voltage of the inspecting drive signal COM1*a* is constant at the reference voltage VB. Among the periods T1 to T4, the second period T2 is a vibration generation period in which pressure vibration is generated in the ink in the pressure chamber 21, and the fourth period T4 is a detection period in which the pressure vibration of ink generated in the second period T2 is detected. The inspecting drive pulse Pd' generated in the second period T2 is an inverted trapezoidal wave that varies from the reference voltage VB to an expansion voltage VL lower than the reference voltage VB and thereafter returns to the reference voltage VB.

The adjusting drive signal COM2*a* is a drive signal having an adjustment pulse Pa1 of an inverted trapezoidal wave that varies from the reference voltage VB to the adjustment voltage Vad (the expansion voltage VL in the present embodiment) lower than the reference voltage VB in the first period T1, maintains the adjustment voltage Vad in the second period T2, the third period T3, and the fourth period T4, and there after varies from the adjustment voltage Vad to the reference voltage VB. That is, the adjusting drive signal COM2*a* is different from the adjusting drive signal COM2 that is constant at the adjustment voltage Vad according to the first embodiment in that the adjusting drive signal COM2*a* has an element in which voltage varies. A waveform element in which voltage varies from the reference voltage VB to the adjustment voltage Vad is not limited to a waveform element generated at an illustrated timing, but may be generated, for example, before the fourth period T4, which is the detection period, as shown by dashed lines. When the inspection target vibration portion is driven by the inspecting drive signal COM1*a*, the constant adjustment voltage Vad is continuously applied to the piezoelectric element 16 of the adjusting vibration portion in the fourth period T4 which is the detection period. Also in this configuration, in the same manner as in the first embodiment, it is possible to adjust the unique vibration period of the inspection target vibration portion. The adjustment voltage Vad may be different from the expansion voltage VL.

The adjusting drive signal COM2*b* is a drive signal having a first stage pulse Pa2*a* having the same shape as that of the inspecting drive pulse Pd' that varies from the reference voltage VB to the adjustment voltage Vad (expansion voltage VL) and thereafter returns to the reference voltage VB in the second period T2 and a second stage pulse Pa2*b* having an inverted trapezoidal wave that varies from the reference voltage VB to the adjustment voltage Vad again in the third period T3, maintains the adjustment voltage Vad constant in the fourth period, and thereafter returns from the adjustment voltage Vad to the reference voltage VB. The adjusting drive signal COM2*b* can amplify the amplitude of the vibration of the inspection target vibration portion by applying the first stage pulse Pa2*a* having the same shape as that of the inspecting drive pulse Pd' to the adjusting vibration portion at a timing when the inspecting drive pulse Pd' of the inspecting drive signal COM1 is applied to the inspection target vibration portion. In other words, the inspection target vibration portion and the adjusting vibration portion are driven in a similar manner and their vibrations resonate, so that the amplitude of the vibration of the inspection target vibration portion is amplified. Thereby, it is possible to further improve the detection accuracy. In this case, the greater the number of the vibration portions that are driven at the same time, the more difficult the bending of the partition wall 25 that delimits the pressure chamber 21 corresponding to the inspection target vibration portion when the inspection target vibration portion vibrates, so that it is possible to further amplify the vibration of the inspection target vibration portion. In the fourth period T4 which is the detection period, the constant adjustment voltage Vad is continuously applied to the piezoelectric element 16 of the adjusting vibration portion. Also in this configuration, in the same manner as in the first embodiment, it is possible to adjust the vibration period of the inspection target vibration portion to match the reference vibration period.

The adjusting drive signal COM2*c* is a drive signal having an adjustment pulse Pa3 that varies from the reference voltage VB to a first adjustment voltage Vad1 in the first period T1, and then maintains the first adjustment voltage Vad1 in the second period T2, varies from the first adjustment voltage Vad1 to a second adjustment voltage Vad2 slightly higher than the first adjustment voltage Vad1 (Vad1<Vad2<VB) in the second period T3, maintains the second adjustment voltage Vad2 in the fourth period T4, and thereafter returns from the second adjustment voltage Vad2 to the reference voltage VB. That is, the adjusting drive signal COM2*c* is different from the other adjusting drive signals in that the adjusting drive signal COM2*c* has two different adjustment voltages Vad1 and Vad2. In the adjusting drive signal COM2*c*, it is possible to select either one of the first adjustment voltage Vad1 and the second adjustment voltage Vad2 as the adjustment voltage applied to the adjusting vibration portion in the fourth period T4 by the pulse selection switch 37. For example, when setting the adjustment voltage applied to the adjusting vibration portion in the fourth period T4 to the first adjustment voltage Vad1, the pulse selection switch 37 is set to a connection state and the adjusting drive signal COM2*c* is applied to the adjusting vibration portion in the first period T1 and the second period T2, and the pulse selection switch 37 is set to a disconnection state at a boundary between the second period T2 and the third period T3. The piezoelectric element 16 behaves like a capacitor, so that the voltage of the piezoelectric element 16 is maintained at the first adjustment voltage Vad1 that is a voltage immediately before the pulse selection switch 37 is disconnected. For example, when setting the adjustment voltage applied to the adjusting vibration portion in the fourth period T4 to the second adjustment voltage Vad2, the pulse selection switch 37 is set to the connection state so that the entire pulse Pa3 of the adjusting drive signal COM2*c* is applied to the adjusting vibration portion in the periods T1 to T4. Alternatively, the pulse selection switch 37 is set to the disconnection state in the periods T1 to T3 and the pulse selection switch 37 is switched to the connection state in the period T4. In this way, a plurality of adjustment voltages are included in the adjusting drive signal COM2*c*, so that it is possible to easily select a more suitable adjustment voltage according to data of a difference from the reference vibration period.

Figure 9:
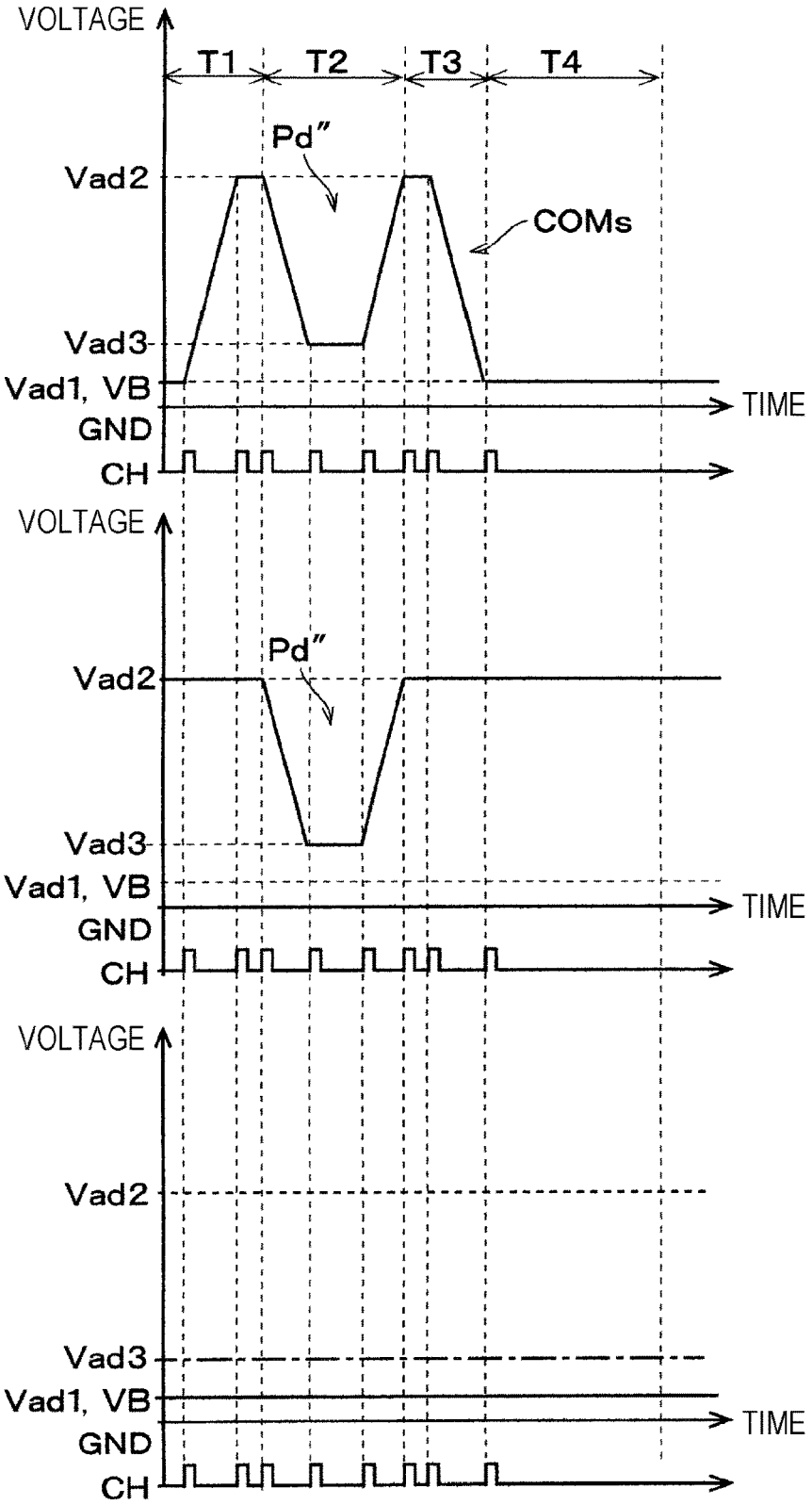
FIG. 9 is a waveform chart for explaining a configuration of a drive signal in a third embodiment.

FIG. 9 is a waveform chart for explaining a configuration of a drive signal COMs in a third embodiment. The upper waveform in FIG. 9 represents an original waveform of the drive signal COMs, the middle waveform represents a waveform of the drive signal COMs applied to the piezoelectric element 16 of the inspection target vibration portion, and the lower waveform represents a waveform of the drive signal COMs applied to the piezoelectric element 16 of the adjusting vibration portion. In the embodiments described above, the inspecting drive signal and the adjusting drive signal are drive signals different from each other. On the other hand, in the present embodiment, different from the embodiments described above, one drive signal serves both as the inspecting drive signal (first drive signal) and the adjusting drive signal (second drive signal). A CH signal which is a control signal of the pulse selection switch 37 is shown corresponding to the drive signal COMs. The drive signal COMs is supplied in common to the piezoelectric element 16 of the inspection target vibration portion and the piezoelectric element 16 of the adjusting vibration portion and a predetermined waveform element of the drive signal COMs is applied by switching of the pulse selection switch 37.

The drive signal COMs shown in an upper section in FIG. 9 is divided into four periods, which are a first period T1, a second period T2, a third period T3 and a fourth period T4. In the first period T1, the drive signal COMs varies from a first adjustment voltage Vad1 which is the reference voltage VB to a second adjustment voltage Vad2 (contraction voltage that causes the pressure chamber 21 to contract) higher than the first adjustment voltage Vad1. In the second period T2, an inspecting drive pulse Pd" of an inverted trapezoidal wave is generated, which varies from the second adjustment voltage Vad2 to a third adjustment voltage Vad3 (expansion voltage that causes the pressure chamber 21 to expand) between the second adjustment voltage Vad2 and the first adjustment voltage Vad1 and returns from the third adjustment voltage Vad3 to the second adjustment voltage Vad2. In the third period T3, the drive signal COMs varies from the second adjustment voltage Vad2 to the first adjustment voltage Vad1, and thereafter, in the fourth period T4, the drive signal COMs is constant at the first adjustment voltage Vad1 (reference voltage VB). Among the periods T1 to T4, the second period T2 is a vibration generation period in which pressure vibration is generated in the ink in the pressure chamber 21, and the fourth period T4 is a detection period in which the pressure vibration of ink generated in the second period T2 is detected.

As shown in a middle section of FIG. 9, from an adjusting drive signal COM2*s*, a constant component at the second adjustment voltage Vad2 in the first period T1, the inspecting drive pulse Pd" in the second period T2, and a constant component at the second adjustment voltage Vad2 in the third period T3 are selectively applied to the piezoelectric element 16 of the inspection target vibration portion by the pulse selection switch 37. As shown in a lower section of FIG. 9, a constant component at the first adjustment voltage Vad1 in the first period T1 and the fourth period T4 is selectively applied to the piezoelectric element 16 of the adjusting vibration portion by the pulse selection switch 37, so that it is possible to maintain the first adjustment voltage Vad1 through the periods T1 to T4 (solid line in FIG. 9). A constant component at the second adjustment voltage Vad2 in the first period T1 and the third period T3 is selectively applied to the piezoelectric element 16 of the adjusting vibration portion by the pulse selection switch 37, so that it is possible to maintain the second adjustment voltage Vad2 through the periods T1 to T4 (dashed line in FIG. 9). Further, a constant component at the third adjustment voltage Vad3 in the second period T2 is selectively applied to the piezoelectric element 16 of the adjusting vibration portion by the pulse selection switch 37, so that it is possible to maintain the third adjustment voltage Vad3 through the periods T1 to T4 (dashed-dotted line in FIG. 9). As described above, even when the drive signal COMs common to the inspection target vibration portion and the adjusting vibration portion is used, by selectively applying a waveform component of the drive signal COMs, it is possible to perform inspection by using the inspecting drive pulse Pd" in the inspection target vibration portion and it is possible to easily select a more suitable adjustment voltage according to data of a difference from the reference vibration period in the adjusting vibration portion.

The configuration of the drive signal is not limited to those illustrated in each embodiment, but it is possible to employ drive signals of various waveforms. In short, any waveform can be employed which can adjust the vibration period of the inspection target vibration portion by driving the inspection target vibration portion to generate pressure vibration in the ink in the pressure chamber 21 in the inspection processing and applying a constant adjustment voltage to the adjusting vibration portion at least in the detection period to maintain a state where the adjusting vibration portion is deformed.

Figure 10:
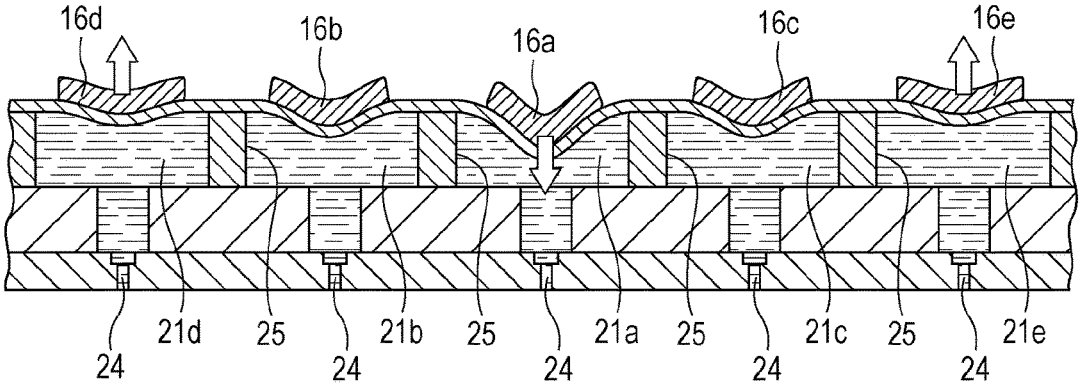
FIG. 10 is a schematic diagram for explaining inspection processing in a fourth embodiment.
Figure 11:
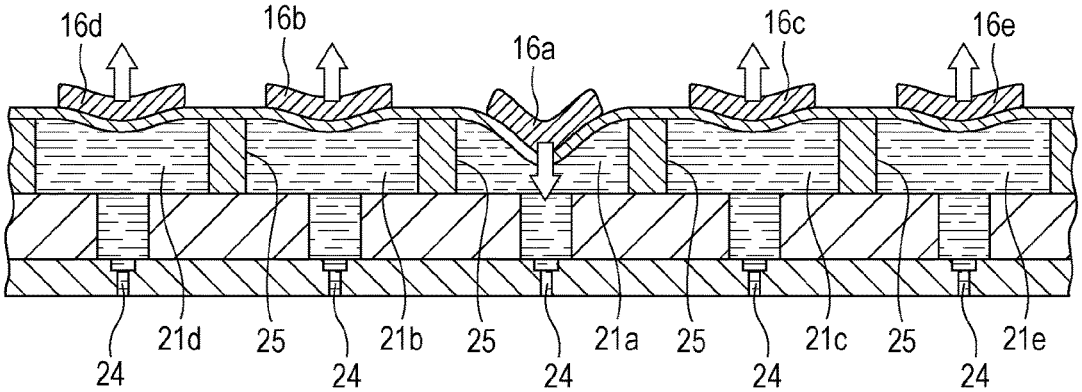
FIG. 11 is a schematic diagram for explaining inspection processing in a fifth embodiment.
Figure 12:
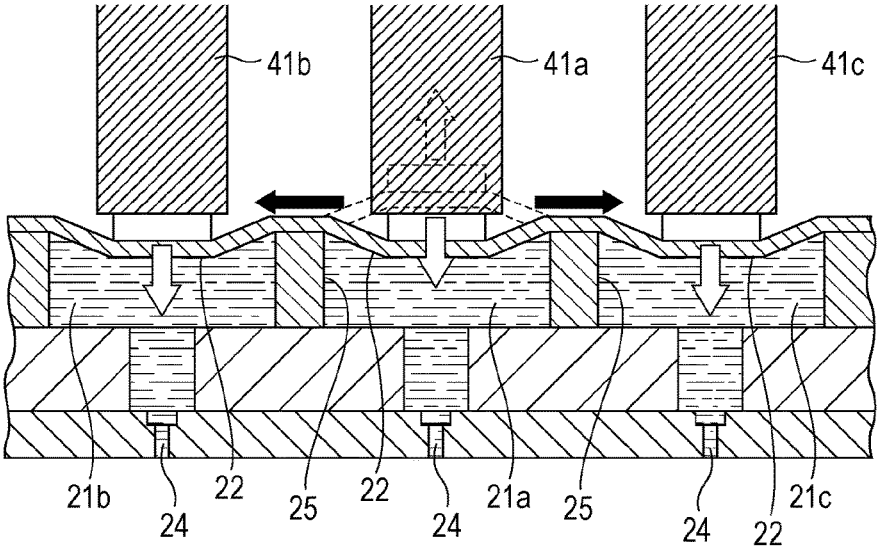
FIG. 12 is a schematic diagram for explaining inspection processing in a sixth embodiment.

FIGS. 10 to 12 are diagrams for explaining the other embodiments of the invention. In the first embodiment described above, a configuration is illustrated in which the piezoelectric elements 16*b* and 16*c* adjacent to the piezoelectric element 16*a*, which is a detecting vibration portion, with one partition wall 25 in between function as the adjusting vibration portion. However, the configuration is not limited to this. For example, like a fourth embodiment shown in FIG. 10, another piezoelectric element 16 (piezoelectric elements 16*b* and 16*c*) not related to detection or adjustment may be arranged between the detecting vibration portion (piezoelectric element 16*a*) and the adjusting vibration portion (piezoelectric elements 16*d* and 16*e*). In short, the piezoelectric element 16 and the flexible plane corresponding to the piezoelectric element 16, which are in a positional relationship where a tension is applied to the detecting vibration portion when the piezoelectric element 16 and the flexible plane are driven as the adjusting vibration portion, can be functioned as the adjusting vibration portion.

Further, like a fifth embodiment shown in FIG. 11, it is also possible to employ a configuration in which three or more (three rows of more) piezoelectric elements 16*b* to 16*e* function as the adjusting vibration portions with respect to one detecting vibration portion. When much more adjusting vibration portions are driven in this way, it is possible to cause much more tension change on the detecting vibration portion. Thereby, it is possible to secure a large adjustment range (in particular, to increase the tension) of the vibration period and the like of the detecting vibration portion.

Further, a piezoelectric element 41 in a sixth embodiment shown in FIG. 12 is a stacked type element manufactured by cutting a piezoelectric plate, where piezoelectric layers and electrode layers (none of them are shown) are alternatively stacked, into a comb-teeth shape, and is a piezoelectric element of a so-called vertical vibration mode of an electric field transversal effect type, which expands and contracts in a direction perpendicular to the stacked direction (electric field direction). For example, in a vibration period of time of the piezoelectric element 41*a* that functions as the detecting vibration portion, piezoelectric elements 41*b* and 41*c* and the flexible planes 22 corresponding to the piezoelectric elements function as the adjusting vibration portion and can adjust the vibration period of the detecting vibration portion. In this example, the lower a voltage of an adjustment signal applied to the adjusting vibration portion, the more the adjusting vibration portion expands, and accordingly the flexible plane 22 is displaced into the pressure chamber 21. Thereby, the flexible plane 22 of the detecting vibration portion is pulled from both sides and a tension is applied to the flexible plane 22. Also in this configuration, it is possible to adjust the vibration period and the like of the detecting vibration portion in the same manner as in each embodiment described above.

The invention can be applied to any liquid ejecting apparatus, which drives a piezoelectric element to eject liquid from a nozzle by pressure vibration generated in ink in the pressure chamber, such as various ink jet type recording apparatuses including not only a printer, but also a plotter, a facsimile apparatus, and a copy machine, and liquid ejecting apparatuses other than the recording apparatuses, such as, for example, a display manufacturing apparatus, an electrode manufacturing apparatus, and a chip manufacturing apparatus.

What is claimed is:

1. A liquid ejecting apparatus comprising:

a liquid ejecting head including a substrate where a plurality of hollow portions are formed, a flexible plane that delimits a part of the hollow portion in the substrate, and a piezoelectric element provided corresponding to and opposite to the hollow portion with the flexible plane in between;

an inspection mechanism that inspects ejection of liquid from a nozzle that communicates with the hollow portion based on an electromotive force of the piezoelectric element caused by vibration generated when the piezoelectric element is driven; and a signal generation circuit that generates a first drive signal applied to a first piezoelectric element to be inspected among a plurality of piezoelectric elements corresponding to the plurality of hollow portions and a second drive signal applied to a second piezoelectric element different from the first piezoelectric element, wherein the second drive signal maintains a state, where a second vibration portion including the second piezoelectric element and the flexible plane corresponding to the second piezoelectric element is deformed, during at least a detection period in which the inspection mechanism performs inspection based on vibration caused when a first vibration portion including the first piezoelectric element and the flexible plane corresponding to the first piezoelectric element is driven.

2. The liquid ejecting apparatus according to claim 1, wherein the second drive signal is maintained at a constant adjustment voltage during the detection period.

3. The liquid ejecting apparatus according to claim 2, further comprising:

a temperature detection mechanism that detects temperature of the liquid ejecting head, wherein the adjustment voltage varies according to the temperature detected by the temperature detection mechanism.

4. The liquid ejecting apparatus according to claim 2, wherein the second drive signal has a plurality of different adjustment voltages.

5. The liquid ejecting apparatus according to claim 1, wherein the second drive signal generates a waveform element that amplifies vibration of the first vibration portion by vibrating the second vibration portion during a vibration generation period in which the first vibration portion is vibrated by the first drive signal before the detection period.

6. The liquid ejecting apparatus according to claim 1, wherein the first vibration portion and the second vibration portion are adjacent to each other with a wall delimiting the hollow portions in between.

* * * * *